US010224162B2

(12) United States Patent
Graefenhahn

(10) Patent No.: US 10,224,162 B2
(45) Date of Patent: Mar. 5, 2019

(54) SWITCHING DEVICE WITH ARC EXTINGUISHING DEVICE

(71) Applicant: Siemens Aktiengesellschaft, Munich (DE)

(72) Inventor: Rudolf Graefenhahn, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/513,051

(22) PCT Filed: Sep. 24, 2014

(86) PCT No.: PCT/EP2014/070336
§ 371 (c)(1),
(2) Date: Mar. 21, 2017

(87) PCT Pub. No.: WO2016/045718
PCT Pub. Date: Mar. 31, 2016

(65) Prior Publication Data
US 2017/0309424 A1 Oct. 26, 2017

(51) Int. Cl.
*H01H 33/08* (2006.01)
*H01H 9/36* (2006.01)
(Continued)

(52) U.S. Cl.
CPC ..... *H01H 33/08* (2013.01); *H01H 9/362* (2013.01); *H01H 71/0214* (2013.01); *H01H 1/20* (2013.01);
(Continued)

(58) Field of Classification Search
CPC ..... H01H 33/08; H01H 33/02; H01H 9/346; H01H 9/345; H01H 9/362; H01H 2205/002; H01H 9/30; H01H 33/04; H01H 9/36
(Continued)

(56) References Cited

U.S. PATENT DOCUMENTS 3,319,035 A * 5/1967 Gelzheiser ..... H01H 21/08 200/302.3
5,635,886 A * 6/1997 Pichard ..... H01H 73/045 335/132
(Continued)

FOREIGN PATENT DOCUMENTS

CN 1886816 12/2006
CN 101673627 3/2010
(Continued)

OTHER PUBLICATIONS

Translation DE60027842 (T2) (Original document published Oct. 5, 2006).*
(Continued)

*Primary Examiner* — Edwin A. Leon
*Assistant Examiner* — William A Bolton
(74) *Attorney, Agent, or Firm* — Cozen O'Connor

(57) ABSTRACT

A single or multiple pole switching device which includes a switch chamber with an arc extinguishing device for each pole, wherein the switch chamber has two lateral walls between which a cage is arranged that is provided for mounting a movable contact bridge, where contacts are arranged on the contact bridge, where the arc extinguishing device has a plurality of quenching plates, the ends of which are accommodated in a pocket arrangement, where the lateral walls have a support for laterally supporting the cage in a direction transverse with respect to the switching direction of the contacts and parallel to the lateral walls, where the pocket arrangement is a separate component from the cage, which pocket arrangement is spaced apart from the cage such that it does not provide such lateral support for the cage, such that a cost-effective and reliable single or multiple pole switching device is provided.

14 Claims, 2 Drawing Sheets

(51) Int. Cl.
*H01H 1/20* (2006.01)
*H01H 71/02* (2006.01)

(52) U.S. Cl.
CPC ... *H01H 71/0207* (2013.01); *H01H 2205/002* (2013.01)

(58) Field of Classification Search
USPC .. 218/149, 15, 30, 31, 34, 46, 81, 134, 139, 218/155, 156; 335/16, 201, 202, 132
See application file for complete search history.

(56) References Cited

U.S. PATENT DOCUMENTS 6,288,354 B1 * 9/2001 Niebler ..... H01H 9/362 218/149
6,556,110 B1 * 4/2003 Niebler ..... H01H 1/2008 335/133
7,285,742 B2 * 10/2007 Kinzler ..... H01H 71/0207 218/34
7,439,469 B2 * 10/2008 Gerving ..... H01H 9/36 218/38
7,598,833 B1 10/2009 Hodges et al.
8,097,824 B2 * 1/2012 Kil ..... H01H 9/36 218/149
2005/0135022 A1 6/2005 Kinzler et al.
2006/0086693 A1 4/2006 Yeon

FOREIGN PATENT DOCUMENTS

DE 103 56 271 A1 6/2005
DE 600 27 842 T2 10/2006
EP 1103996 5/2001
JP 2006-120643 5/2006

OTHER PUBLICATIONS

Office Action dated Jul. 30, 2018 issued in the corresponding Chinese Patent Application No. 201480081140.4.

* cited by examiner

SWITCHING DEVICE WITH ARC EXTINGUISHING DEVICE

CROSS-REFERENCE TO RELATED APPLICATIONS

This is a U.S. national stage of application No. PCT/EP2014/070336 filed 24 Sep. 2014.

BACKGROUND OF THE INVENTION

1. Field of the Invention

The invention relates to a single or multiple-pole switching device having a switching chamber with an arc extinguishing device for each pole, each switching chamber including two side walls between that a cage is arranged which is provided for mounting a movable contact bridge, with contacts being arranged on the contact bridge, where the arc extinguishing device includes a plurality of quenching plates, the ends of which are received in a pocket arrangement.

2. Description of the Related Art

Switching devices are used, for example, in industrial circuit technology. Switching devices are often configured therein as power circuit breakers. These are special switching devices, the main purpose of which is to switch non-destructively and under electrical load (i.e., in the current-carrying state) the downstream devices current-free and voltage-free, in order to protect them, for example, against overloading and/or short-circuit damage. The downstream devices requiring protection include, inter alia, motors, transformers and other electrical devices.

DE 103 56 271 A1 discloses a switching device having a switching structure that comprises a cage assembly with two side walls and a bottom wall, where the cage assembly is at least partially configured as a cage in which a slider is displaceably mounted. Here, a moving contact bridge associated with stationary contact members is held in an opening of the slide, under the pressure of a contact pressure spring. For displacement of the contact bridge, a free space is provided between the two first side walls. A limit stop is provided to retain the slide. The switch structure also comprises switching chambers formed by insulating second side walls, where the second side walls delimit a volume that contains the opening arcs, and the second side walls are arranged on opposite sides of the cage assembly including the cage, and are each separated therefrom by a gap. Further disclosed is a web that engages form-fittingly in the gap between the cage assembly and the side walls and thus entirely fills it.

DE 600 27 842 T2 discloses a switching device that comprises an arc extinguishing chamber housing, which is provided with arc extinguishing ribs, where this device is intended to be used in each pole of switching devices, in particular multiple-pole low voltage disconnectors or contactors. In this device, side walls of the arc extinguishing chamber housing are provided, which have guiding means for the ends of the arc extinguishing ribs. Preferably, these guiding means have a body that is formed on each side wall toward the interior of the arc extinguishing chamber housing and is extended via a side rib substantially parallel to the side wall and with this wall forms a seating that can receive the ends of the arc extinguishing ribs. The body can have, for example, a substantially right-angled cross-section over the whole height of the wall. The length of the side rib enables the ends to be sufficiently covered in order to isolate them electrically on occurrence of an arc from the moving contacts, the static contacts and the bridge from moving contacts.

SUMMARY OF THE INVENTION

It is an object of the present invention to provide a single or multiple-pole switching device having a device for extinguishing arcs which consists of as few individual parts as possible, which can be manufactured economically and automatably and which has sufficient mechanical and thermal stability under the influence of an arc.

This and other objects and advantages are achieved in accordance with the invention by a switching device in which the side walls comprise a holder for laterally holding the cage in a direction extending transversely to a switching movement direction of the contacts and parallel to the side walls, where a pocket arrangement is a component separate from the cage and is spaced from the cage such that it does not provide such a lateral hold for the cage.

A lateral hold is intended here to mean the hold that holds the cage not in the switching direction, but in the direction of the quenching plates, so that the movement of the contact bridge is fixed such that, inter alia, no electrical contact can come about between the contact bridge and the quenching plates.

The invention is based on the recognition that in the prior art due, for example, to thermal expansion in the case of an electric arc, forces are exerted on the cage which, in turn, can impair the proper movement of the contact bridge in the cage.

The construction of the switching device in accordance with the invention is realized with a small number of individual parts which, with automatic assembly, brings great advantages with respect to throughput time and costs. Furthermore, the construction of the switching device per se and the combination of cage and a pocket arrangement in particular with respect to the force effects of the housing on the cage in the event of an arc are optimized to prevent jamming or tilting of the contact bridge. Herein, the side walls and the pocket arrangement preferably have even wall thicknesses, by which the tendency to change the original form and to distort are reduced. In addition to its static properties, the cage can also be optimized with respect to its sliding friction properties and abrasion resistance for a long lifespan in accordance with specifications.

In a further embodiment, the holder consists of a pair of protrusions per side wall, between which a groove is formed in which a correspondingly formed counterelement engages form-fittingly on the cage. The lateral hold of the cage thereby created prevents, within the context of the usual tolerances, slipping of the cage and thus slipping of the contact bridge in the direction of the quenching plates. The lateral hold can herein naturally also be created by any tongue and groove, mortise and tenon, dovetail or other joints already well known from the prior art.

In another embodiment, the pocket arrangement in which quenching plate ends are received and electrically isolated in relation to the contact bridge can be connected to the respective side wall in a form-fitting or force-fitting manner, welded or ideally also directly formed on during the production process of the side walls. Thus, no additional part with the function of the pocket arrangement is necessary, which simplifies the construction and the production of the switching device. Furthermore, through direct forming-on a high degree of positional accuracy of both the pocket arrangement itself and also the quenching plate is achieved, which additionally reduces the serial production variability of the switching device and favors a consistently high quality.

In a further embodiment, a counterelement of the holder is not centrally mounted on the cage, but mounted asymmetrically or with a central offset to define a pre-set installation position of the cage for the assembly. The holder is accordingly to be provided with a central offset in relation to the cage at the side walls. Herein, the holder must not necessarily be placed symmetrically on the two side walls that receive the cage, but rather can be optimized from other aspects, such as material strength of the side walls at the position of the holder.

In other embodiments, the pocket arrangement is produced from an electrically insulating material that insulates the quenching plates and the contact bridge from the quenching stack. Furthermore, the pocket arrangement can have a plurality of evenly spaced ribs into which the parallel quenching plates are received and mechanically stabilize them and electrically insulate them from one another.

In a further embodiment, the pocket arrangement has an extension at the end that points in the direction of the cage, which reduces the spacing between the cage and the pocket arrangement, which leads to an optimum sealing of the switching chamber relative to the side walls, and which thus ensures good guidance of the arc in the switching chamber. It is herein further advantageous that the switching chamber is as compact as possible, which is optimum for the guidance of the arc in the direction of the quenching stack. Also advantageously, the spacing between the cage and the extension of the pocket arrangement can be reduced by the configuration of the cage and the extension to a minimum, which further improves the guidance of the arc. An example herein is a cut-out or a groove in the cage, into which the extension of the pocket arrangement projects.

In order not to impair the functioning of the switching device in the case of an arc, the spacing between the cage and the extension of the pocket arrangement is to be selected at least large enough such that, through the extreme influences of the arc, no welding of the two elements occurs. Also to be taken into account in this consideration is the criterion that with temperature-related expansion of the material from which the pocket arrangement and its extension are made, unfavorable force influences on the cage are to be prevented and jamming or tilting of the contact bridge can thus be prevented. Thus, it is ensured not only that the cage can always guide the contact bridge optimally, but that the cage can also be exchanged without difficulty after a certain operating cycle.

The separation of the cage from the side walls and the pocket arrangement further has the advantage that all elements can be optimized with respect to their essential properties. The side walls and the pocket arrangement are to be optimized with respect to their insulating properties and, furthermore, the starting properties under the action of arcs are relevant to achieve good arc guidance and rapid arc quenching.

With the cage, above all the sliding friction properties of the selected material are of prime importance, where the abrasion resistance and the temperature resistance should not be overlooked. For this purpose above all, polyamides and in particular CREAMID® or ULTRAMID® suggest themselves.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will now be described and explained in greater detail making reference to the exemplary embodiments illustrated in the drawings, in which.

DETAILED DESCRIPTION OF THE EXEMPLARY EMBODIMENTS

Figure 1:
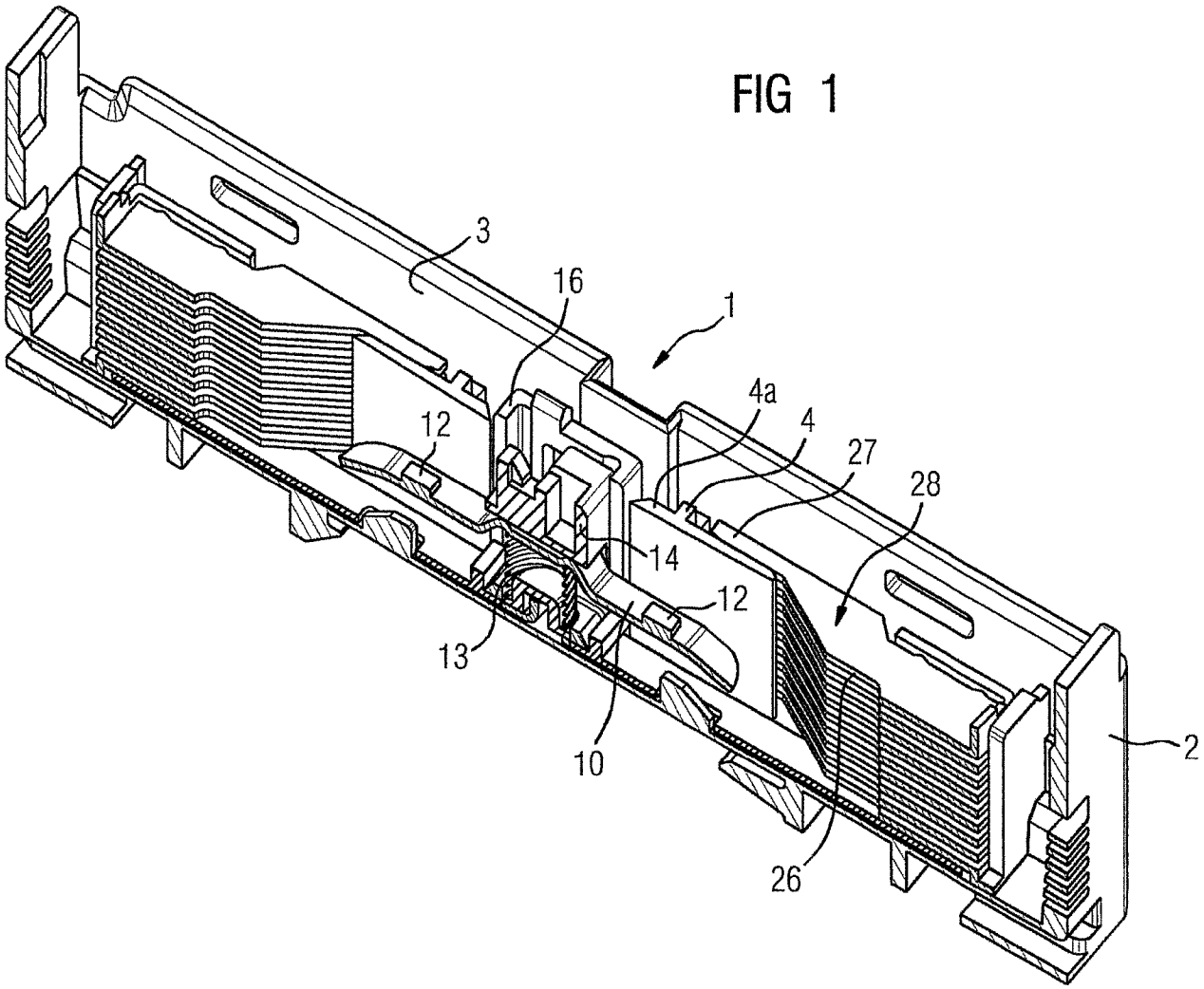
FIG. 1 is a cross-sectional view of a switching device with an arc extinguishing device in accordance with invention.

FIG. 1 shows a cross-section through an inventive switching device 1 with an arc extinguishing device that essentially consists of a pocket arrangement 4 and a quenching stack 28 constructed from a plurality of quenching plates 26 and their quenching plate ends 27. The section is taken through a switching chamber 5 and a contact bridge 10 of the switching device. Also shown are a side wall 3, configured here as an external wall, the pocket arrangement 4 and its extension 4*a*. A cage 16 is held laterally by a holder 7, where the cage 16 covers the holder 7, so that the holder is not shown here (see FIG. 2, however). The section through the contact bridge 10 shows the arrangement of one contact 12 per side and the arrangement of the contact bridge 10 in the cage 16. Herein, the contact bridge 10 is held by a spring 13 and can be moved by a contact slider 14.

The spacing between the cage 16 and the pocket arrangement 4 and its extension 4*a* is herein selected so that the arc is optimally guided away from the contacts into the arc extinguishing device. This effect can be intensified by a slope on the extension 4*a*. The quenching plates 26 that are electrically insulated relative to one another form the quenching stack 28 in which the arc is then extinguished. The cage 16 is configured as a separate part and can thus be optimized with regard to the sliding friction and abrasion resistance of importance for a long operating life. Easy exchange of the cage 16 is also possible. This configuration is optimized both for a long operating life and also for an economical, simple and automatable assembly.

Figure 2:
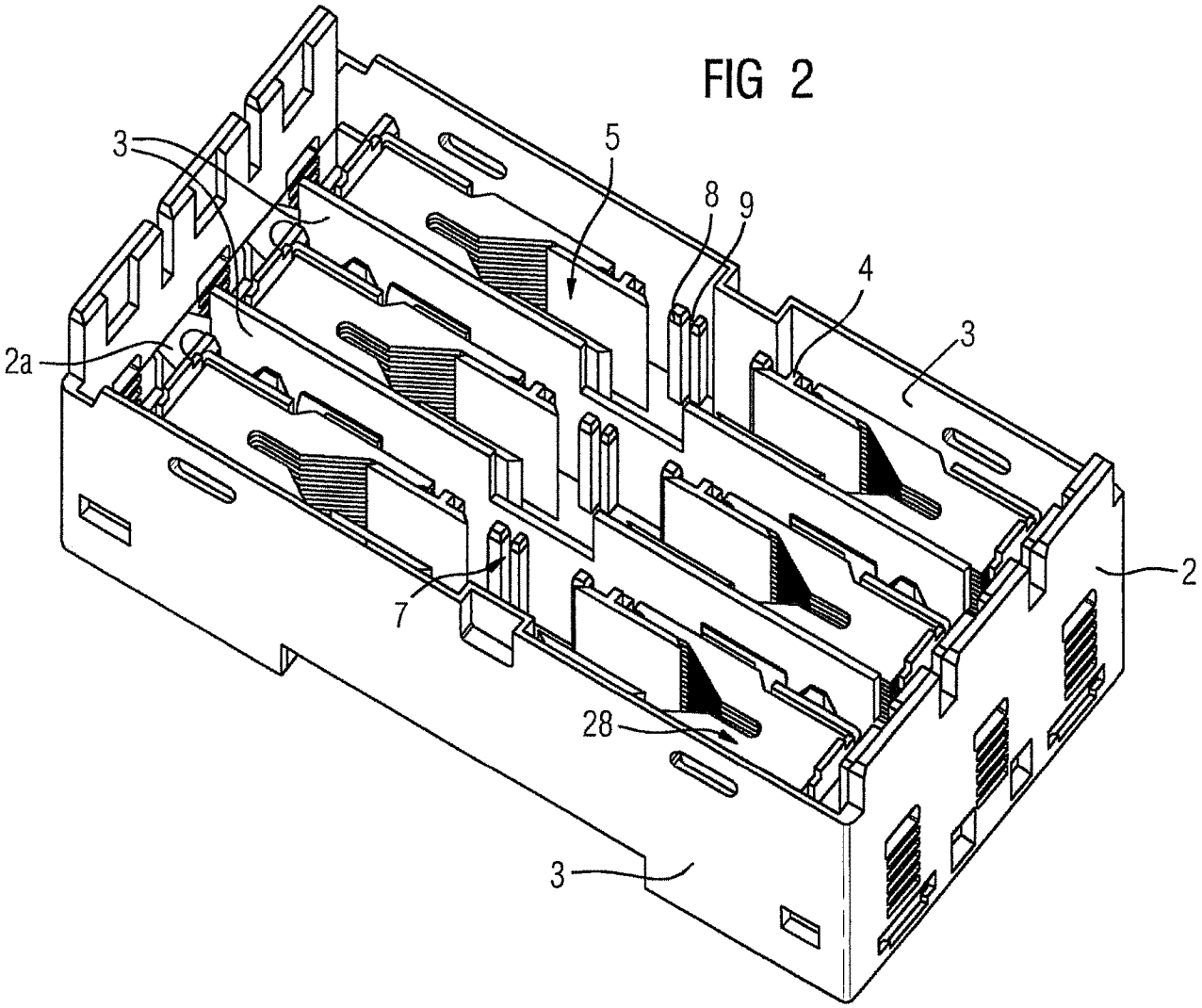
FIG. 2 is a perspective view of a three-poled switching device without the cage and contact bridge in accordance with the invention.

FIG. 2 shows a three-pole configured switching device 1 in which, for reasons of clarity, the cage 16 and the contact bridge 10 are not shown. The reference characters already used with reference to FIG. 1 are used here again. The holder 7, the protrusions 8 and a groove 9 used in this embodiment are visible. The side walls 3 are partially configured as separating walls between two switching chambers 5 or as external walls of a switching chamber 5. The switching chamber 5 is substantially laterally delimited by the pocket arrangement 4 and its extension 4*a* and by the quenching stack 28. Two quenching stacks 28 per pole are provided between the side walls 3 and fixed via the quenching plate ends 27 in the pocket devices 4.

A housing 2 is herein configured in one part, but can also be constructed such that it must be assembled from a plurality of parts. Guide rails 2*a* are provided for the side walls 4 that are not configured as external walls, i.e., are arranged in the interior of the housing. The holders 7 for the cage 16 are not arranged centrally, in order to define an unambiguous installation position of the cage 16. This provides the advantage that, upon assembly of the switching device, the cage 16 is always correctly arranged and a faulty construction of the switching device 1 is prevented. The construction can naturally be used not only for three-pole, but also similarly for single-pole or multiple-pole switching devices.

The invention relates to a single or multiple-pole switching device which has a switching chamber with an arc extinguishing device for each pole. The switching chamber has two side walls between which a cage is arranged that carries a movable contact bridge. Contacts are arranged on the contact bridge. The arc extinguishing device has a plurality of quenching plates, the ends of which are received in a pocket arrangement.

In order to provide an economical and reliable single or multiple-pole switching device, it the side walls comprise a holder for a lateral hold of the cage in a direction extending transversely to a switching movement direction of the contacts and parallel to the side walls, where the pocket arrangement is a component separate from the cage and is spaced from the cage such that it does not provide any such lateral hold for the cage.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those element steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A single or multiple-pole switching device comprising:

at least one switching chamber having an arc extinguishing device for each pole of the switch device, each arc extinguishing device including a plurality of quenching plates having ends which are received in a pocket arrangement having a perpendicularly extending abutment;

a movable contact bridge, contacts being arranged on the movable contact bridge;

a cage for storing the movable contact bridge, each switching chamber including two side walls between which the cage is arranged;

wherein the side walls comprise a holder for a laterally holding the cage in a direction extending transversely to a switching movement direction of the contacts and parallel to the side walls; and wherein the pocket arrangement comprises an extension at one end which extends in a direction of the cage in a planar manner at a side opposite to the perpendicularly extending abutment, said pocket arrangement being configured as a component separate from the cage and being spaced from the cage such that said pocket arrangement does not provide any such lateral hold for the cage and wherein the pocket arrangement is formed on the side wall or welded to the side wall.

2. The switching device as claimed in claim 1, wherein the holder is configured as protrusions arranged on the side wall; and wherein a groove is arranged between the protrusions a corresponding counter-element of the cage protruding into the grove.

3. The switching device as claimed in claim 2, wherein the side walls and the pocket arrangement have walls of even thicknesses.

4. The switching device as claimed in claim 2, wherein the protrusions are formed on the side wall.

5. The switching device as claimed in claim 1, wherein the side walls and the pocket arrangement have walls of even thicknesses.

6. The switching device as claimed in claim 1, wherein the pocket arrangement electrically isolates ends of quenching plates with respect to the contact bridge.

7. The switching device as claimed in claim 6, wherein the pocket arrangement comprises ribs arranged in parallel for receiving the ends of the quenching plates, said ribs ensuring mutual electrical insulation and spacing of adjacent quenching plates.

8. The switching device as claimed in claim 1, wherein said extension reduces spacing between the cage and the pocket arrangement such that guidance of an arc in the switching chamber is ensured.

9. The switching device as claimed in claim 8, wherein the cage and the extension of the pocket arrangement have a cooperating configuration such that a separation between the cage and the pocket arrangement is minimized to ensure guidance of the arc.

10. The switching device as claimed in claim 9, wherein the cage includes a cut-out into which the extension protrudes.

11. The switching device as claimed in claim 8, wherein the cage includes a cut-out into which the extension protrudes.

12. The switching device as claimed in claim 8, wherein the spacing between the cage and the pocket arrangement is at least set such that even in an event of an arc, no unwanted welding occurs between the two components.

13. The switching device as claimed in claim 1, wherein the cage is made of polyamide.

14. The switching device as claimed in claim 1, wherein the switching device is configured as a power circuit breaker.

* * * * *